US008007051B2

(12) United States Patent
Hall et al.

(10) Patent No.: US 8,007,051 B2
(45) Date of Patent: Aug. 30, 2011

(54) SHANK ASSEMBLY

(75) Inventors: David R. Hall, Provo, UT (US); Ronald B. Crockett, Payson, UT (US); Jeff Jepson, Spanish Fork, UT (US); Tyson J. Wilde, Spanish Fork, UT (US); Jad Mills, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 522 days.

(21) Appl. No.: 11/947,644

(22) Filed: Nov. 29, 2007

(65) Prior Publication Data

US 2008/0067859 A1 Mar. 20, 2008

Related U.S. Application Data

(63) Continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which (Continued)

(51) Int. Cl.
*E21C 35/197* (2006.01)

(52) U.S. Cl. ..... 299/113; 299/107

(58) Field of Classification Search ..... 299/79.1, 299/111, 113, 105, 107, 104
See application file for complete search history.

(56) References Cited

U.S. PATENT DOCUMENTS 2,004,315 A 6/1935 Fean (Continued)

FOREIGN PATENT DOCUMENTS

DE 3307910 A1 9/1984

(Continued)

OTHER PUBLICATIONS

Hoch, "Is There Room for Geothermal Energy?", Dec. 2006/Jan. 2007, Innovation: America's Journal of Technology Commercialization.

(Continued)

*Primary Examiner* — John Kreck
(74) *Attorney, Agent, or Firm* — Holme Roberts & Owen LLP

(57) ABSTRACT

In one aspect of the invention, a pick comprises a carbide bolster disposed intermediate an impact tip and a shank assembly. The impact tip comprises a superhard material bonded to a carbide substrate, and the tip is bonded to the bolster opposing a base of the bolster. The shank assembly comprises a central axis, a first end that protrudes into a cavity formed in the base of the bolster, and also an inducible attachment mechanism disposed proximate the first end. The inducible attachment mechanism is adapted to attach the shank assembly to the carbide bolster and restrict movement of the shank assembly with respect to the carbide bolster. The attachment mechanism may restrict movement of the shank assembly in a direction parallel to the central axis.

23 Claims, 9 Drawing Sheets

Related U.S. Application Data is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 11/947,644, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 2,040,263 | A | | 5/1936 | Layne et al. |
| 2,124,438 | A | | 7/1938 | Struk |
| 2,247,499 | A | | 7/1941 | Hutchison, Jr. |
| 2,972,713 | A | | 2/1961 | Sutton, Jr. |
| 3,089,215 | A | | 5/1963 | Stubbs |
| 3,254,392 | A | | 6/1966 | Novkov |
| 3,342,531 | A | | 9/1967 | Krekeler |
| 3,342,532 | A | | 9/1967 | Krekeler |
| 3,397,012 | A | | 8/1968 | Krekeler |
| 3,512,838 | A | | 5/1970 | Kniff |
| 3,595,124 | A | | 7/1971 | Lindstrand et al. |
| 3,627,381 | A | | 12/1971 | Krekeler |
| 3,650,565 | A | | 3/1972 | Kniff |
| 3,655,244 | A | | 4/1972 | Swisher |
| 3,746,396 | A | | 7/1973 | Radd |
| 3,778,112 | A | | 12/1973 | Krekeler |
| 3,800,891 | A | | 4/1974 | White |
| 3,807,804 | A | | 4/1974 | Kniff |
| 3,830,321 | A | | 8/1974 | McKenry |
| 3,929,054 | A | | 12/1975 | Gutshall et al. |
| 3,932,952 | A | | 1/1976 | Helton |
| 3,942,838 | A | * | 3/1976 | Bailey et al. ..... 299/113 |
| 3,945,681 | A | | 3/1976 | White |
| 3,957,307 | A | | 5/1976 | Varda |
| 4,005,914 | A | | 2/1977 | Newman |
| 4,006,936 | A | | 2/1977 | Crabiel |
| 4,076,318 | A | | 2/1978 | Hauschopp |
| 4,098,362 | A | | 7/1978 | Bonnice |
| 4,109,737 | A | | 8/1978 | Bovenkerk |
| RE29,900 | E | | 2/1979 | Kniff |
| 4,149,753 | A | | 4/1979 | Stoltz et al. |
| 4,156,329 | A | | 5/1979 | Daniels |
| 4,199,035 | A | | 4/1980 | Thompson |
| 4,201,421 | A | | 5/1980 | Den Besten |
| 4,247,150 | A | | 1/1981 | Wrulich et al. |
| 4,268,089 | A | | 5/1981 | Spence |
| 4,277,106 | A | | 7/1981 | Sahley |
| 4,397,362 | A | | 8/1983 | Dice et al. |
| 4,439,250 | A | | 3/1984 | Acharya et al. |
| 4,465,221 | A | | 8/1984 | Schmidt et al. |
| 4,484,644 | A | | 11/1984 | Cook |
| 4,484,783 | A | | 11/1984 | Emmerich |
| 4,489,986 | A | | 12/1984 | Dziak |
| 4,497,520 | A | | 2/1985 | Ojanen |
| 4,537,448 | A | | 8/1985 | Ketterer |
| 4,583,786 | A | | 4/1986 | Thorpe et al. |
| 4,627,665 | A | | 12/1986 | Ewing et al. |
| 4,647,111 | A | | 3/1987 | Bronder |
| 4,660,890 | A | | 4/1987 | Mills |
| 4,669,786 | A | | 6/1987 | Morgan |
| 4,678,237 | A | | 7/1987 | Collin |
| 4,682,987 | A | | 7/1987 | Brady |
| 4,684,176 | A | | 8/1987 | Den Besten |
| 4,688,856 | A | | 8/1987 | Elfgen |
| 4,694,918 | A | | 9/1987 | Hall |
| 4,702,525 | A | | 10/1987 | Sollami |
| 4,725,098 | A | | 2/1988 | Beach |
| 4,728,153 | A | | 3/1988 | Ojanen |
| 4,729,603 | A | | 3/1988 | Elfgen |
| 4,746,379 | A | | 5/1988 | Rabinkin |
| 4,765,686 | A | | 8/1988 | Adams |
| 4,765,687 | A | | 8/1988 | Parrott |
| 4,776,862 | A | | 10/1988 | Wiand |
| 4,804,231 | A | | 2/1989 | Buljan et al. |
| 4,811,801 | A | | 3/1989 | Salesky et al. |
| 4,850,649 | A | | 7/1989 | Beach et al. |
| 4,880,154 | A | | 11/1989 | Tank |
| 4,893,875 | A | | 1/1990 | Lonn |
| 4,921,310 | A | | 5/1990 | Hedlund et al. |
| D308,683 | S | | 6/1990 | Meyers |
| 4,932,723 | A | | 6/1990 | Mills |
| 4,940,288 | A | | 7/1990 | Stiffler |
| 4,944,559 | A | | 7/1990 | Sionnet |
| 4,951,762 | A | | 8/1990 | Lundell |
| 4,956,238 | A | | 9/1990 | Griffin |
| 5,007,685 | A | | 4/1991 | Beach |
| 5,011,515 | A | | 4/1991 | Frushour |
| 5,018,793 | A | | 5/1991 | Den Besten |
| 5,112,165 | A | | 5/1992 | Hedlund |
| 5,119,714 | A | | 6/1992 | Scott et al. |
| 5,141,289 | A | | 8/1992 | Stimer |
| 5,154,245 | A | | 10/1992 | Waldenstrom |
| 5,186,892 | A | | 2/1993 | Pope |
| 5,251,964 | A | | 10/1993 | Ojanen |
| 5,261,499 | A | | 11/1993 | Grubb |
| 5,303,984 | A | | 4/1994 | Ojanen |
| 5,332,348 | A | | 7/1994 | Lemelson |
| 5,333,938 | A | | 8/1994 | Gale |
| 5,374,111 | A | | 12/1994 | Den Besten et al. |
| 5,415,462 | A | | 5/1995 | Massa |
| 5,417,475 | A | | 5/1995 | Graham |
| 5,447,208 | A | | 9/1995 | Lund |
| 5,494,477 | A | | 2/1996 | Flood et al. |
| 5,503,463 | A | | 4/1996 | Ojanen |
| 5,535,839 | A | | 7/1996 | Brady |
| 5,542,993 | A | | 8/1996 | Rabinkin |
| 5,653,300 | A | | 8/1997 | Lund |
| 5,662,720 | A | | 9/1997 | O'Tigheamaigh |
| 5,713,412 | A | | 2/1998 | Wepfer |
| 5,720,528 | A | | 2/1998 | Ritchey |
| 5,725,283 | A | | 3/1998 | O'Neill |
| 5,738,698 | A | | 4/1998 | Kapoor |
| 5,823,632 | A | | 10/1998 | Burkett |
| 5,837,071 | A | | 11/1998 | Andersson et al. |
| 5,842,747 | A | | 12/1998 | Winchester |
| 5,845,547 | A | | 12/1998 | Sollami |
| 5,875,862 | A | | 3/1999 | Jurewicz |
| 5,884,979 | A | | 3/1999 | Latham |
| 5,890,552 | A | | 4/1999 | Scott et al. |
| 5,934,542 | A | | 8/1999 | Nakamura |
| 5,935,718 | A | | 8/1999 | Demo |
| 5,944,129 | A | | 8/1999 | Jensen |
| 5,967,250 | A | | 10/1999 | Lund |
| 5,992,405 | A | | 11/1999 | Sollami |
| 6,000,483 | A | | 12/1999 | Jurewicz et al. |
| 6,004,349 | A | | 12/1999 | Jackson |
| 6,006,846 | A | | 12/1999 | Tibbitts |
| 6,019,434 | A | | 2/2000 | Emmerich |
| 6,044,920 | A | | 4/2000 | Massa |
| 6,051,079 | A | | 4/2000 | Andersson |
| 6,056,911 | A | | 5/2000 | Griffin |
| 6,065,552 | A | | 5/2000 | Scott |
| 6,086,160 | A | | 7/2000 | Bitelli |
| 6,113,195 | A | | 9/2000 | Mercier |
| 6,170,917 | B1 | | 1/2001 | Heinrich |
| 6,193,770 | B1 | | 2/2001 | Sung |
| 6,196,636 | B1 | | 3/2001 | Mills |
| 6,196,910 | B1 | | 3/2001 | Johnson |
| 6,199,956 | B1 | | 3/2001 | Kammerer |
| 6,216,805 | B1 | | 4/2001 | Lays |
| 6,270,165 | B1 | | 8/2001 | Peay |

| | | | | |
|---|---|---|---|---|
| 6,341,823 | B1 | 1/2002 | Sollami | |
| 6,354,771 | B1 | 3/2002 | Bauschulte | |
| 6,357,832 | B1 | 3/2002 | Sollami | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,460,637 | B1 | 10/2002 | Siracki et al. | |
| 6,478,383 | B1 | 11/2002 | Ojanen | |
| 6,481,803 | B2 | 11/2002 | Ritchey | |
| 6,499,547 | B2 | 12/2002 | Scott | |
| 6,508,516 | B1 | 1/2003 | Kammerer | |
| 6,517,902 | B2 | 2/2003 | Drake | |
| RE38,151 | E | 6/2003 | Penkunas | |
| 6,585,326 | B2 | 7/2003 | Sollami | |
| 6,585,327 | B2 | 7/2003 | Sollami | |
| 6,601,662 | B2 | 8/2003 | Matthias et al. | |
| 6,644,755 | B1 | 11/2003 | Kammerer | |
| 6,651,758 | B2 | 11/2003 | Xiang et al. | |
| 6,659,206 | B2 | 12/2003 | Liang et al. | |
| 6,685,273 | B1 | 2/2004 | Sollami | |
| 6,692,083 | B2 | 2/2004 | Latham | |
| 6,702,393 | B2 | 3/2004 | Mercier | |
| 6,709,065 | B2 | 3/2004 | Peay | |
| 6,719,074 | B2 | 4/2004 | Tsuda | |
| 6,732,914 | B2 | 5/2004 | Cadden | |
| 6,733,087 | B2 * | 5/2004 | Hall et al. | 299/113 |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,854,810 | B2 | 2/2005 | Montgomery, Jr. | |
| 6,861,137 | B2 | 3/2005 | Griffin | |
| 6,863,352 | B2 | 3/2005 | Sollami | |
| 6,880,744 | B2 | 4/2005 | Noro et al. | |
| 6,889,890 | B2 | 5/2005 | Yamazaki | |
| 6,938,961 | B2 * | 9/2005 | Broom | 299/100 |
| 6,962,395 | B2 | 11/2005 | Mouthaan | |
| 6,966,611 | B1 | 11/2005 | Sollami | |
| 6,994,404 | B1 | 2/2006 | Sollami | |
| 7,094,473 | B2 | 8/2006 | Takayama et al. | |
| 7,204,560 | B2 | 4/2007 | Mercier | |
| 7,234,782 | B2 | 6/2007 | Stehney | |
| 7,316,532 | B2 | 1/2008 | Matthys-Mark | |
| 7,369,743 | B2 | 5/2008 | Noro | |
| 7,380,888 | B2 | 6/2008 | Ojanen | |
| 7,387,345 | B2 | 6/2008 | Hall et al. | |
| 7,390,066 | B2 | 6/2008 | Hall et al. | |
| 7,413,258 | B2 | 8/2008 | Hall et al. | |
| 2003/0209366 | A1 | 11/2003 | McAlvain | |
| 2003/0230926 | A1 | 12/2003 | Mondy | |
| 2004/0026983 | A1 * | 2/2004 | McAlvain | 299/111 |
| 2004/0065484 | A1 | 4/2004 | McAlvain | |
| 2006/0125306 | A1 | 6/2006 | Sollami | |
| 2006/0237236 | A1 | 10/2006 | Sreshta | |
| 2006/0261663 | A1 | 11/2006 | Sollami | |

FOREIGN PATENT DOCUMENTS

| | | | |
|---|---|---|---|
| DE | 3500261 | | 7/1985 |
| DE | 3431495 | | 3/1986 |
| DE | 3818213 | | 11/1989 |
| DE | 4039217 | | 6/1992 |
| DE | 19821147 | | 11/1999 |
| DE | 10163717 | | 5/2003 |
| EP | 0295151 | A2 | 12/1988 |
| EP | 0412287 | A2 | 2/1991 |
| GB | 2004315 | A | 3/1979 |
| GB | 2037223 | | 11/1979 |
| JP | 5280273 | | 10/1993 |
| JP | 3123193 | | 1/2001 |

OTHER PUBLICATIONS

Glowka, "Progress in the Advanced Synthetic-Diamond Drill Bit Program," 1995, US Dept. of Energy.

Durrand, "Super-Hard, thick, Shaped PDC cutters for Hard Rock Drilling: Development and Test Results," 2010, Novatek International.

Jennejohn, "Research & Development in Geothermal Exploration & Drilling," Dec. 2009, pp. 15, 18-19, Geothermal Energy Association, Washington, D.C.

Taylor, "The State of Geothermal Technology Part 1: Subsurface Technology," Nov. 2007, pp. 29-30, Geothermal Energy Association, Washington, D.C.

U.S. Dept. Of Energy, "Geothermal Drilling Faster & Cheaper is Better," May 2000, Geothermal Today, p. 28, National Renewal Energy Laboratory, Golden, Colorado.

* cited by examiner

SHANK ASSEMBLY

CROSS REFERENCE TO RELATED APPLICATIONS

This application is a continuation-in-part of U.S. patent application Ser. No. 11/844,586 filed on Aug. 24, 2007 and now U.S. Pat. No. 7,600,823 issued on Oct. 13, 2009. U.S. patent application Ser. No. 11/844,586 is a continuation-in-part of U.S. patent application Ser. No. 11/829,761, which was filed on Jul. 27, 2007 and is now U.S. Pat. No. 7,722,127 issued on May 25, 2010. U.S. patent application Ser. No. 11/829,761 is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007 and is now U.S. Pat. No. 7,475,948 issued on Jan. 13, 2009. U.S. patent application Ser. No. 11/742,304 is a continuation of U.S. patent application Ser. No. 11/742,261 which was filed on Apr. 30, 2007 and is now U.S. Pat. No. 7,469,971 issued on Dec. 30, 2008. U.S. patent application Ser. No. 11/742,261 is a continuation-in-part of U.S. patent application Ser. No. 11/464,008 which was filed on Aug. 11, 2006 and is now U.S. Pat. No. 7,338,135 issued on Mar. 4, 2008. U.S. patent application Ser. No. 11/464,008 is a continuation-in-part of U.S. patent application Ser. No. 11/463,998 which was filed on Aug. 11, 2006 and is now U.S. Pat. No. 7,384,105 issued on Jun. 10, 2008. U.S. patent application Ser. No. 11/463,998 is a continuation-in-part of U.S. patent application Ser. No. 11/463,990 which was filed on Aug. 11, 2006 and is now 7,320,505 issued on Jan. 22, 2008. U.S. patent application Ser. No. 11/463,990 is a continuation-in-part of U.S. patent application Ser. No. 11/463,975 which was filed on Aug. 11, 2006 and is now 7,445,294 issued on Nov. 4, 2008. U.S. patent application Ser. No. 11/463,975 is a continuation-in-part of U.S. patent application Ser. No. 11/463,962 which was filed on Aug. 11, 2006 and is now U.S. Pat. No. 7,413,256 issued on Aug. 19, 2008. U.S. patent application Ser. No. 11/463,962 is a continuation-in-part of U.S. patent application Ser. No. 11/463,953, which was filed on Aug. 11, 2006 and is now U.S. Pat. No. 7,464,993 issued on Dec. 16, 2008. The present application is also a continuation-in-part of U.S. patent application Ser. No. 11/695,672 which was filed on Apr. 3, 2007 and is now U.S. Pat. No. 7,396,086 issued on Jul. 8, 2008. U.S. patent application Ser. No. 11/695,672 is a continuation-in-part of U.S. patent application Ser. No. 11/686,831 filed on Mar. 15, 2007 and is now U.S. Pat. No. 7,568,770 issued on Aug. 4, 2009. All of these applications are herein incorporated by reference for all that they contain.

BACKGROUND OF THE INVENTION

Formation degradation, such as pavement milling, mining, or excavating, may result in wear on impact resistant picks. Consequently, many efforts have been made to extend the working life of these picks by optimizing the shape of the picks or the materials with which they are made. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, all of which are herein incorporated by reference for all that they contain.

BRIEF SUMMARY OF THE INVENTION

In one aspect of the invention, a pick comprises a carbide bolster disposed intermediate an impact tip and a shank assembly. The impact tip comprises a superhard material bonded to a carbide substrate, and the tip is bonded to the bolster opposing a base of the bolster. The shank assembly comprises a central axis, a first end that protrudes into a cavity formed in the base of the bolster, and also an inducible attachment mechanism disposed proximate the first end. The inducible attachment mechanism is adapted to attach the shank assembly to the carbide bolster and restrict movement of the shank assembly with respect to the carbide bolster. The attachment mechanism may restrict movement of the shank assembly in a direction parallel to the central axis.

The attachment mechanism may be adapted to restrict rotation of the shank assembly about the central axis when the shank assembly is attached to the carbide bolster. In some embodiments the inducible attachment mechanism may also be adapted to inducibly release the shank assembly from attachment with the carbide bolster.

The inducible attachment mechanism may comprise an insertable locking mechanism and also a locking shaft connected to an expanded locking head. The insertable locking mechanism and locking head may be disposed within the cavity of the carbide bolster and the locking shaft may protrude from the cavity into an inner diameter of the shank assembly. The locking shaft may be adapted for translation in a direction parallel to the central axis of the shank assembly.

The attachment mechanism may comprise a wedge disposed within the cavity of the carbide bolster. In some embodiments the wedge may be fixed to the carbide bolster. The first end of the shank assembly may be adapted to expand when the wedge is inserted into the first end.

The first end of the shank assembly may comprise a plurality of prongs. The plurality of prongs may be adapted to interlock with the cavity of the carbide bolster. An internal surface of the cavity of the bolster may comprise outwardly tapered surfaces. A split ring may be disposed in the cavity of the bolster intermediate the first end of the shank assembly and an inner surface of the bolster.

The shank assembly may comprise inner and outer diameters. The shank assembly may comprise a hollow portion within the inner diameter and may also comprise an opening to the hollow portion in a second end of the shank assembly. The shank assembly may comprise a constricted inner diameter proximate the first end. A wedge may be disposed within the inner diameter of the shank assembly. In some embodiments the wedge may comprise a first set of threads that corresponds to a second set of threads disposed on an inner surface of the shank assembly.

In some embodiments the attachment mechanism may comprise a plurality of extendable arms that are each perpendicular to a central axis of the shank assembly. Each of the plurality of extendable arms may be adapted to interlock with the carbide bolster by extending into a recess disposed in the cavity of the carbide bolster. In some embodiments fluid pressure on an expandable bladder disposed within the shank assembly may cause the bladder to expand and thereby extend the plurality of extendable arms away from the central axis. Translation of an activating mechanism in a direction parallel to the central axis may extend the plurality of extendable arms away from the central axis. The activating mechanism may interlock with at least a portion of at least one of the plurality of extendable arms and thereby maintains the extension of the arm away from the central axis.

DETAILED DESCRIPTION OF THE INVENTION AND THE PREFERRED EMBODIMENT

Figure 1:
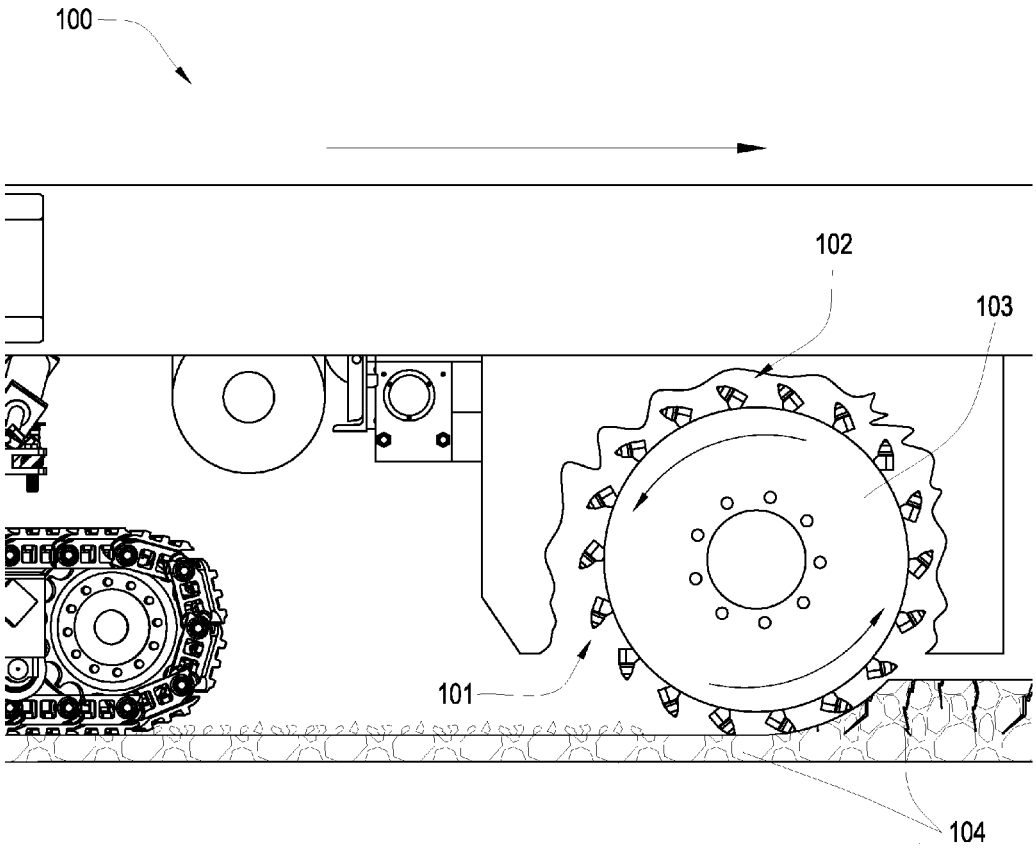
FIG. 1 is a cross-sectional diagram of an embodiment of a milling machine.

FIG. 1 is a cross-sectional diagram of an embodiment of a plurality of picks 101 attached to a driving mechanism 103, such as a rotating drum connected to the underside of a pavement milling machine 100. The milling machine 100 may be a cold planer used to degrade manmade formations such as a paved surface 104 prior to the placement of a new layer of pavement. Picks 101 may be attached to the driving mechanism 103 bringing the picks 101 into engagement with the formation. A holder 102, which may be a block, an extension in the block or a combination thereof, is attached to the driving mechanism 103, and the pick 101 is inserted into the holder 102. The holder 102 may hold the pick 101 at an angle offset from the direction of rotation, such that the pick 101 engages the pavement at a preferential angle. In addition to milling machines, the pick 101 may be adapted for use in a downhole rotary drill bit, in a horizontal directional drill bit, in trenching machines, in mining machines, and in coal mining machines.

Figure 2:
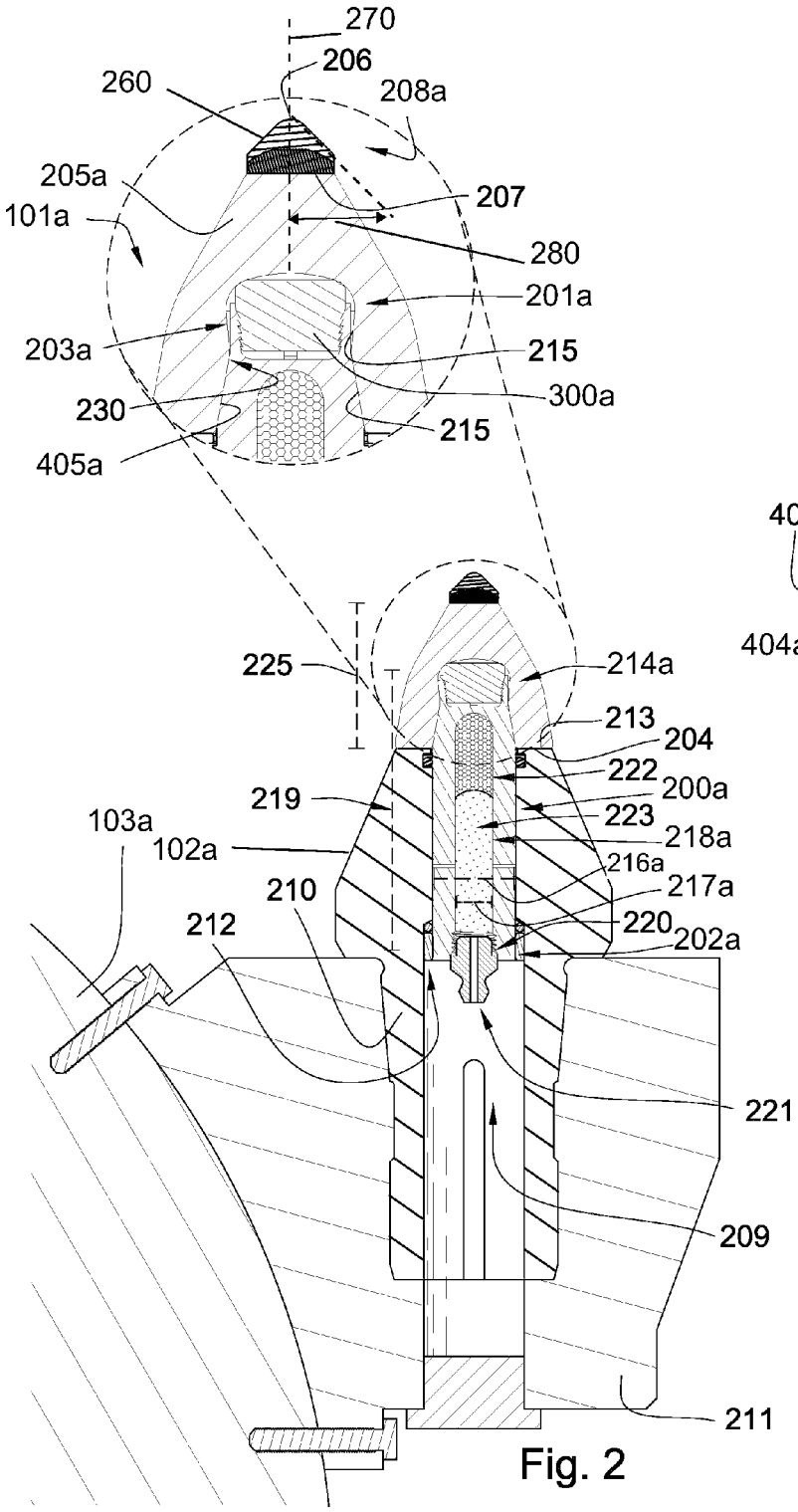
FIG. 2 is a cross-sectional diagram of an embodiment of a high-impact resistant pick disposed on a milling drum.
Figure 3:
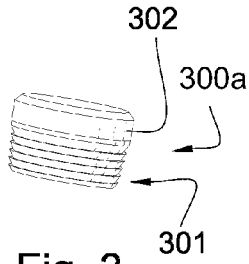
FIG. 3 is a perspective diagram of an embodiment of a wedge.
Figure 4:
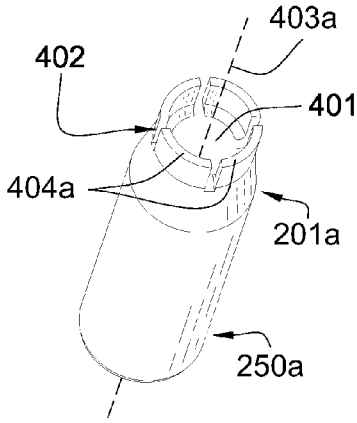
FIG. 4 is a perspective diagram of an embodiment of a portion of a shank assembly.

Referring now to FIGS. 2-4, a pick 101*a* may be designed for high-impact resistance and long life while milling the paved surface 104 of FIG. 1. Exemplary pick 101*a* comprises a shank assembly 200*a* comprising a shank 250*a* having a first end 201*a* and a second end 202*a*. The first end 201*a* may be press fit into a cavity 203*a* in a base 204*a* of a bolster 205*a*. A super hard material 206 is bonded to a cemented metal carbide substrate 207 to form a wear-resistant tip 208, which is then bonded to the bolster 205*a* opposite the base 204*a* of the bolster 205*a* and the first end 201*a* of the shank 250. The shank 250 may comprise a hard material such as steel, hardened steel, or other materials of similar hardness. The bolster 205*a* may comprise tungsten, titanium, tantalum, molybdenum, niobium, cobalt and/or combinations thereof. The super hard material 206 may be a material selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon-bonded diamond, metal-bonded diamond, silicon carbide, cubic boron nitride, and combinations thereof.

The second end 202*a* of the shank 250*a* is disposed within a bore 209*a* of a holder 102*a*, which may comprise an extension 210 or a block 211 attached to a driving mechanism 103*a*, or both the extension 210 and the block 211. The shank 250*a* may be held into the holder 102*a* by a retaining clip 212 adapted to fit in an inset portion of the shank 250. An outer surface of the holder 102*a* may comprise hard-facing in order to provide better wear protection for the holder 102*a*. The hard-facing may comprise ridges after it is applied, though the ridges may be machined down afterward. The base 204*a* of the bolster 205*a* may be in direct contact with an upper face 213 of the holder 102*a*, and may overhang the holder 102*a* and hard-facing, which may prevent debris from collecting on the upper face 213. The bore 209*a* of the holder 102*a* may comprise hard-facing. One method of hard-facing the bore 209*a* is case-hardening, during which process the bore 209*a* is enriched with carbon and/or nitrogen and then heat treated, which hardens the bore 209*a* and provides wear protection. Other methods of hard-facing the bore may also be used.

The shank 250*a* may be work-hardened in order to provide resistance to cracking or stress fractures due to forces exerted on the pick by the paved surface 104 of FIG. 1 or the holder 102*a*. The shank 250*a* may be work-hardened by shot-peening the shank 250*a*, chrome plating the shank 250*a*, enriching the shank 250*a* with nitrogen, or other methods of work-hardening. The shank 250*a* may also be rotatably held into the holder 102*a*, such that the pick 101*a* is allowed to rotate within the holder 102*a*. The first end 201*a* of the shank 250*a* protrudes into the cavity 203*a* in the base 204*a* of the bolster 205*a*. The shank assembly 200*a* further comprises an inducible attachment mechanism 214*a* disposed at the first end 201*a* of the shank 250*a*. The inducible attachment mechanism 214*a* is adapted to attach the shank 250*a* to the bolster 205*a* and restrict movement of the shank 250*a* with respect to the bolster 205*a*.

In FIG. 2 the inducible attachment mechanism 214*a* radially expands at least a portion of the shank 250*a* outward to engage the cavity 203*a* of the bolster 205*a*. This engagement may attach the shank 250*a* to the bolster 205*a*, thereby preventing movement of the shank 250*a* with respect to the bolster 205*a*. The shank 250*a* may be prevented by the attachment mechanism 214*a* from moving in a direction parallel to a central axis 403*a* of the shank 250*a*. In some embodiments the shank 250*a* may be preventing by the attachment mechanism 214*a* from rotating about the central axis 403*a* of the shank 250*a*.

In the embodiment of FIG. 2 through FIG. 4, the attachment mechanism 214*a* comprises a wedge 300*a* that is disposed within the cavity 203*a*. FIG. 3 is a perspective diagram of an embodiment of a wedge 300*a* comprising ridges 301 along a portion of an outside surface 302 of the wedge 300*a*.

FIG. 4 is a perspective diagram of an embodiment of the first end 201*a* of a shank 250*a*. The first end 201*a* comprises a seat 401 into which the wedge 300*a* may be inserted. As the shank assembly 200*a* is inserted into the cavity 203*a* the wedge 300*a* is forced into the seat 401 of the first end 201*a*, and thereby an expandable portion 402 of the first end 201*a* is forced outward, away from the central axis 403*a* of the shank 250*a*, and into engagement with an internal surface 405*a* of the bolster 205*a* in the cavity 203*a*. Although in the present embodiment the expandable portion 402 of the first end 201*a* comprises a plurality of prongs 404*a*, in some embodiments the expandable portion 402 may extend continuously along a diameter of the shank 250.

In FIG. 2 the internal surface 405*a* of the cavity 203*a* comprises an apex 230 formed by an intersection of two outwardly tapered surfaces 215 and the cavity 203*a* comprises a generally hour-glass shaped geometry. The shank 250*a* comprises an inner diameter 217*a* and an outer diameter 216*a*. A hollow portion 218*a* of the shank 250*a* is disposed within the inner diameter 217*a* along at least a part of a length 219*a* of the shank 250*a*. The shank 250*a* also comprises an opening 220 to the hollow portion 218*a*. The opening 220 is disposed in the second end 202*a* of the shank 250*a*. In FIG. 2 the opening is controlled by a one-way check valve 221. A lubricant reservoir 223 is disposed in the hollow portion 218*a* intermediate the check valve 221 and a piston assembly 222.

The pick 101*a* may be lubricated by inserting a lubricant into the reservoir 223 through the bore 209*a* of the holder 102*a* and through the one-way valve 221. The piston assembly 222 may be disposed within the bore 209*a* such that as more lubricant is inserted into the bore 209*a*, the piston assembly 222 may compress to allow the lubricant to be inserted. After the lubricant is inserted into the bore 209*a*, the piston assembly 222 may apply pressure on the lubricant, which may force it up around the shank assembly 200*a* and out of the holder 102*a*. This may allow the pick 101*a* to rotate more easily and may decrease friction while the pick 101*a* rotates for better wear protection of areas in contact with the holder 102*a*, such as the base 204*a* of the bolster 205*a* and the shank 250*a*.

A weeping seal may be disposed around the shank assembly 200*a* such that it is in contact with the shank 250*a*, the bolster 205*a*, and the holder 102*a*, which may limit the rate at which the lubricant is expelled from the bore 209*a* of the holder 102*a*. The lubricant may also be provided from the driving mechanism 103*a*. In embodiments, where the driving mechanism 103*a* is a drum, the drum may comprise a lubrication reservoir and a port may be formed in the drum which leads to the lubrication reservoir. In some embodiments a spiral groove may be formed in the shank 250*a* or the bore 209*a* of the holder 102*a* to aid in exposing the surfaces of the shank 250*a* and the bore 209*a* of the holder 102*a* to the lubricant. In some embodiments, the lubricant is added to the bore 209*a* of the holder 102*a* prior to securing the shank 250*a* within the holder 102*a*. In such an embodiment, the insertion of the shank 250*a* may penetrate the volume of the lubricant forcing a portion of the volume to flow around the shank 250*a* and also compressing the lubricant within the bore 209*a* of the holder 102*a*.

Dimensions of the shank assembly 200*a* and bolster 205*a* may be important to the function and efficiency of the pick 101*a*. A ratio of a length 219*a* of the shank assembly 200*a* to a length 225 of the bolster 205*a* may be from 1.75:1 to 2.5:1. A ratio of a maximum width of the bolster 205*a* to the outer diameter 216 of the shank 250*a* may be from 1.5:1 to 2.5:1. The first end 201*a* of the shank 250*a* may be fitted into the cavity 203*a* of the bolster 205*a* to a depth of 0.300 to 0.700 inches. The cavity 203*a* of the bolster 205*a* may comprise a depth from 0.600 to 1 inch. The shank 250*a* may or may not extend into the full depth 305 of the bore 209 of the holder 102*a*. The shank assembly 200*a* and bolster 205*a* may also comprise an interference fit from 0.0005 to 0.005 inches. The bolster may comprise a minimum cross-sectional thickness between the internal surface 405*a* of the cavity 203 and an outside surface of the bolster 205*a* of 0.200 inches, preferable at least 0.210 inches. Reducing the volume of the bolster 205*a* may advantageously reduce the cost of the pick 101*a*.

The cemented metal carbide substrate 207 may comprise a height of 0.090 to 0.250 inches. The super hard material 206 bonded to the substrate 207 may comprise a substantially pointed geometry with an apex comprising a 0.050 to 0.160 inch radius, and a 0.100 to 0.500 inch thickness from the apex to an interface where the super hard material 206 is bonded to the substrate 207. Preferably, the interface is non-planar, which may help distribute loads on the tip 208 across a larger area of the interface.

The side wall 260 of the superhard material may form an included angle 280 with a central axis 270 of the tip 208 between 30 to 60 degrees. In asphalt milling applications, the inventors have discovered that an optimal included angle 280 is 45 degrees, whereas in mining applications the inventors have discovered that an optimal included angle 280 is between 35 and 40 degrees.

A tip 208 that may be compatible with the present invention is disclosed in U.S. patent application Ser. No. 11/673,634 to Hall and is currently pending.

The wear-resistant tip 208 may be brazed onto the carbide bolster 205 at a braze interface. Braze material used to braze the tip 208 to the bolster 205 may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material nay comprise 47.2 weight percent nickel, 46.7 weight percent palladium, and 6.1 weight percent silicon. Active cooling during brazing may be critical in some embodiments, since the heat from brazing may leave some residual stress in the bond between the carbide substrate 207 and the super hard material 206. The farther away the super hard material is from the braze interface, the less thermal damage is likely to occur during brazing. Increasing the distance between the brazing interface and the super hard material 206, however, may increase the moment on the carbide substrate 207 and increase stresses at the brazing interface upon impact. The shank assembly 200 may be press fitted into the bolster 205 before or after the tip 208 is brazed onto the bolster 205.

Figure 5:
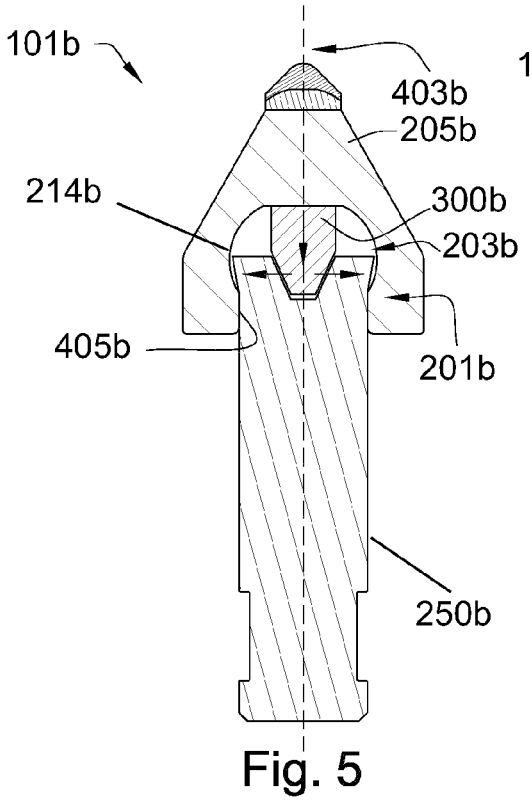
FIG. 5 is a cross-sectional diagram of an embodiment of a high-impact resistant pick.

Referring now to the embodiment of FIG. 5, an attachment mechanism 214*b* is shown wherein a first end 201*b* of a shank 250*b* is adapted to expand when a wedge 300*b* is inserted into the first end 201*b*. The insertion of the wedge 300*b* into the first end 201*b* may coincide with insertion of the shank 250*b* into a cavity 203*b*. The expansion of the first end 201*b* away from a central axis 403*b* of the shank 250*b* may strengthen the attachment between the bolster 205*b* and the shank 250*b*.

Figure 6:
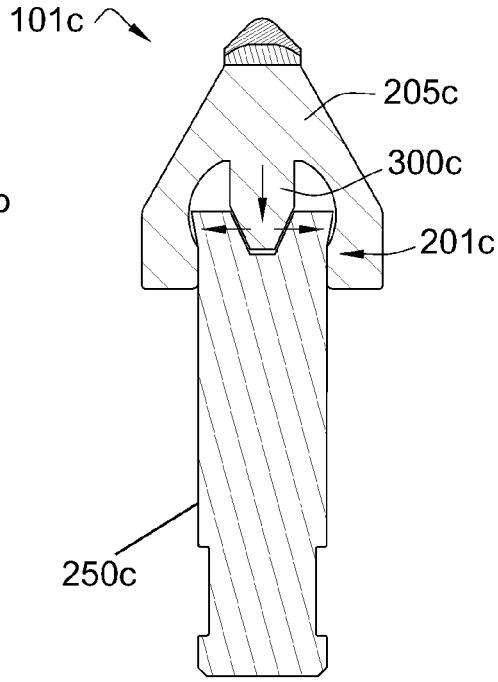
FIG. 6 is a cross-sectional diagram of another embodiment of a pick.

The embodiment of FIG. 6 discloses an attachment mechanism 214*c* that includes a wedge 300*c* fixed to a bolster 205*c*.

A shank 250*c* is adapted to expand when the wedge 300*c* is inserted into a first end 201*c* of the shank 250*c* cemented metal carbide.

Figure 7:
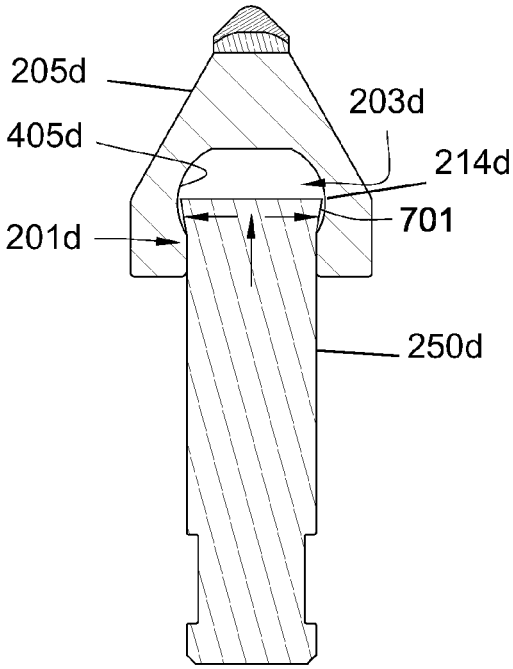
FIG. 7 is a cross-sectional diagram of another embodiment of a pick.

FIG. 7 discloses an embodiment of the invention in which an attachment mechanism 214*d* is an outwardly tapered surface 701 disposed on a first end 201*d* of a shank 250*d*. As the shank 250*d* is inserted into a cavity 203*d*, the tapered surface 701 may attach a bolster 205*d* and the shank 250*d* by expanding the first end 201*d* of the shank 250*d* into contact with an internal surface 405*d* of the cavity 203*d*.

Figure 8:
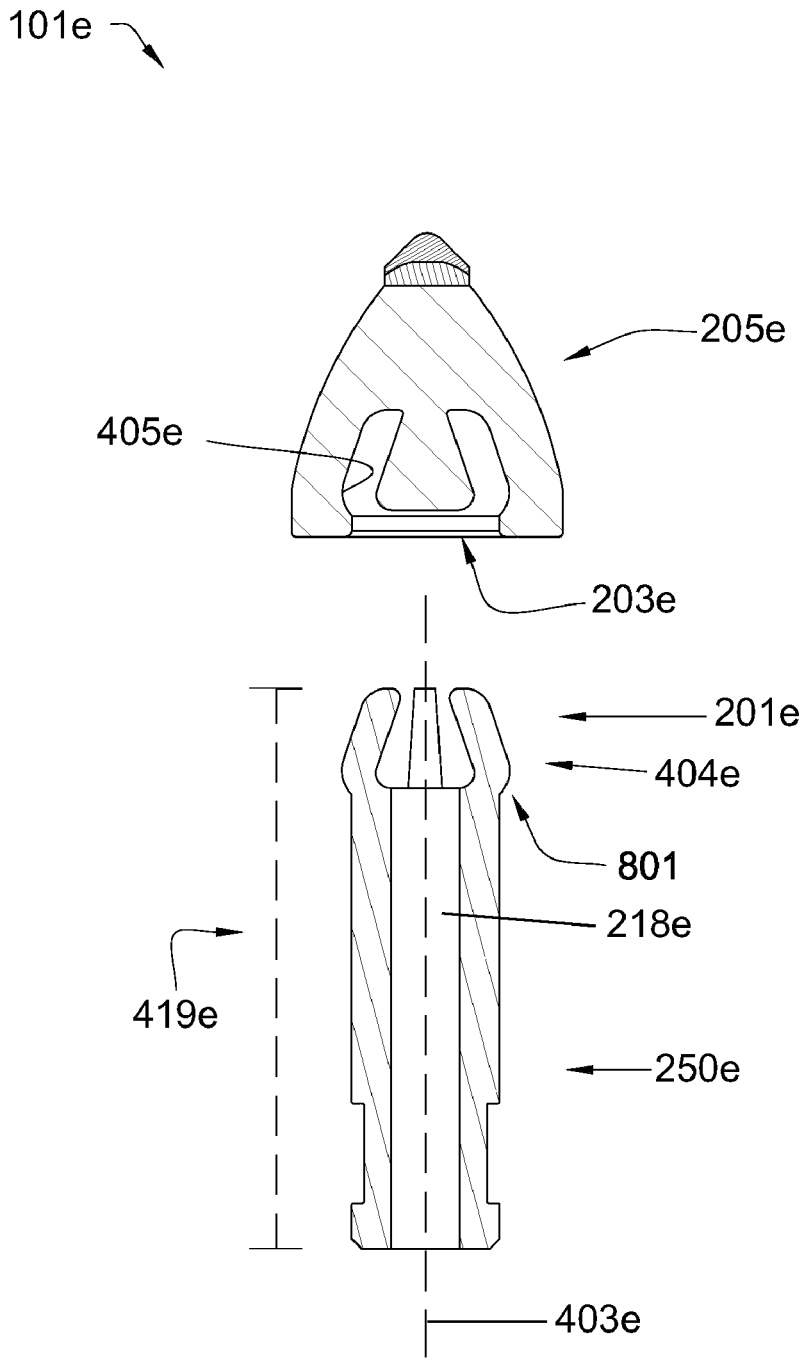
FIG. 8 is a cross-sectional diagram of another embodiment of a pick.

Referring now to FIG. 8, an embodiment is disclosed in which a plurality of prongs 404*e* are adapted to interlock with a cavity 203*e* of a bolster 205*e*. The prongs 404*e* may have a characteristic of a flexible resistance against moving toward the central axis 403*e* defined by its spring constant K. This flexible resistance may generate a force directed away from the central axis 403*e* and toward an internal surface 405*e* of the cavity 203*e*. This force may strengthen the connection between the shank 250*e* and the bolster 205*e*.

In the present embodiment a first end 201*e* comprises a ledge 801 and the prongs 404*e* are tapered inward from the ledge 801 toward a central axis 403*e* of a shank 250*e*. The cavity 203*e* is shaped to receive the plurality of prongs 404*e* and to interlock with the prongs 404*e*. As the first end 201*e* of the shank 250*e* enters the cavity 203*e* the prongs 404*e* may flex toward the central axis 403*e*.

The shank 250*e* may be adapted to snap into place as the ledge 801 enters the cavity 203*e* so that the ledge 801 rests inside the cavity 203*e*.

Although the present embodiment discloses an entirely hollow shank 250*e*, in some embodiments a hollow portion 218*e* of the shank 250*e* may extend along only a portion of the length 419*e* of the shank 250*e*.

Figure 9:
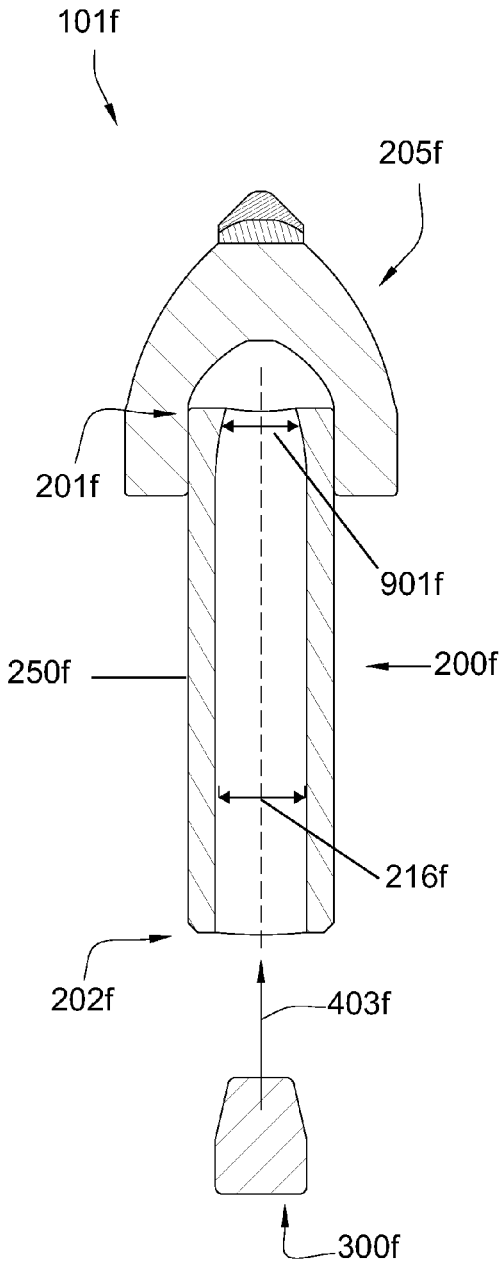
FIG. 9 is an exploded cross-sectional diagram of another embodiment of a pick.

Referring now to FIG. 9, an embodiment is disclosed in which a shank assembly 200*f* comprises a wedge 300*f* and a shank 250*f* having a constricted inner diameter 901*f* proximate a first end 201*f*. The constricted inner diameter 901*f* is smaller than an inner diameter 216*f*. The wedge 300*f* may be inserted into the shank 250*f* by passing the wedge 300*f* from a second end 202*f* towards the first end 201*f*. As the wedge 300*f* approaches the first end 201*f*, the constricted diameter 901*f* may cause the wedge 300*f* to exert a force on the shank 250*f* that is directed away from a central axis 403*f* of the shank 250*f*. This force may attach the shank 250*f* assembly 200 to a bolster 205*f*. The wedge 300*f* may then still be disposed within the inner diameter 216*f*.

Figure 10:
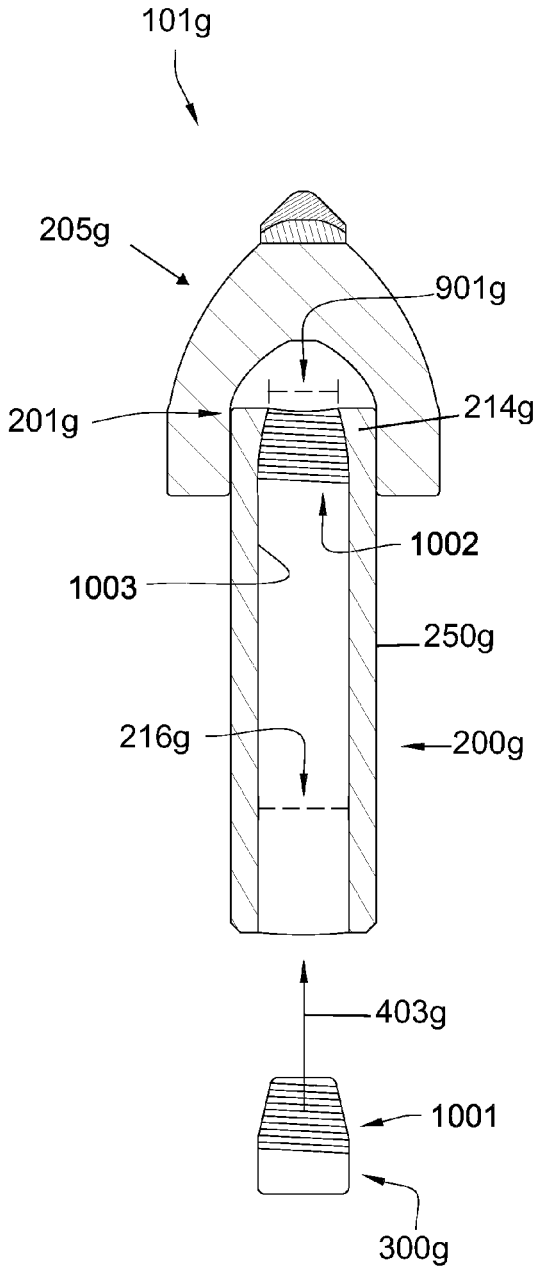
FIG. 10 is an exploded cross-sectional diagram of another embodiment of a pick.

In FIG. 10 an embodiment of a shank assembly 200*g* is disclosed in which a wedge 300*g* comprises a first set of threads 1001 that correspond to a second set of threads 1002. The second set of thread 1002 is disposed on an inner surface 1003 of a shank 250*g*. As the wedge 300*g* approaches a first end 201*g* of a shank 250*g*, the wedge 300*g* may be rotated about a central axis 403*g* of the shank 250*g* and the first set of threads 1001 may interlock with the second set of threads 1002. This may maintain the wedge 300*g* inside an inner diameter 216*g* and proximate the first end 201*g* and a constricted diameter 901*g* of the shank 250*g*. This feature may also allow the wedge 300*g* to be removed by rotating the wedge 300*g* about the central axis 403*g* in a direction opposite an original direction used to place the wedge 300*g* proximate the constricted diameter 901*g*. In this embodiment the attachment mechanism 214*g* is adapted to inducibly release the shank 250*g* from attachment with a bolster 205*g*.

Figure 11:
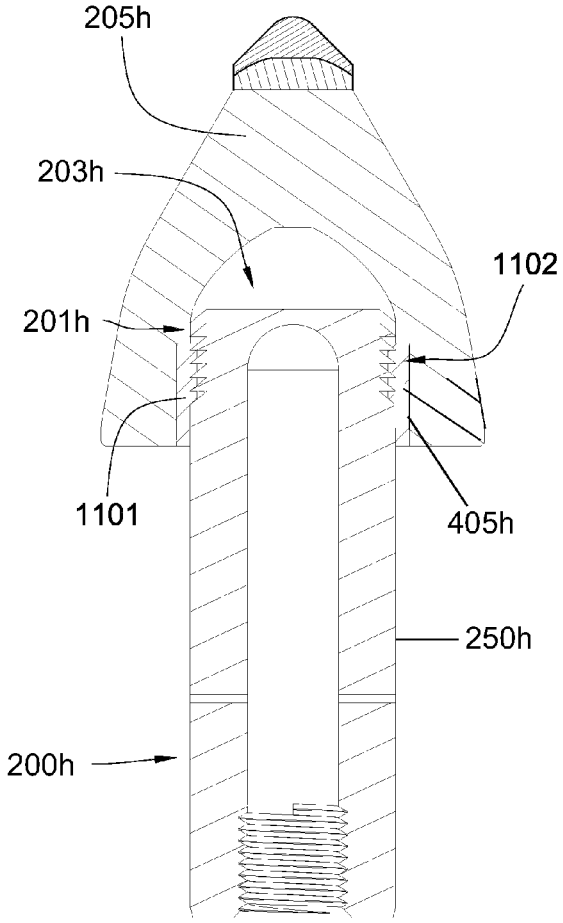
FIG. 11 is a cross-sectional diagram of another embodiment of a pick.

Referring now to the embodiment of FIG. 11, a split ring 1101 may be disposed in a cavity 203*h* of a bolster 205*h* intermediate a first end 201*h* of a shank 250*h* and an internal surface 405*h* of the bolster 205*h*. Attachment of the shank 250*h* to the bolster 205*h* may induce stress on the bolster 205*h*. The split ring 1101 may mediate the effect of this stress on the bolster 205*h*.

FIG. 11 discloses an embodiment where a first end 201*h* of shank 250*h* comprises ridges 1102 on an outer diameter of the shank 250*h*. The ridges 1102 may help maintain contact between the shank 250*h* and the split ring 1101. In some embodiments the split ring 1101 may be press fit into the cavity 203*h* of the bolster 205*h*.

Figure 12:
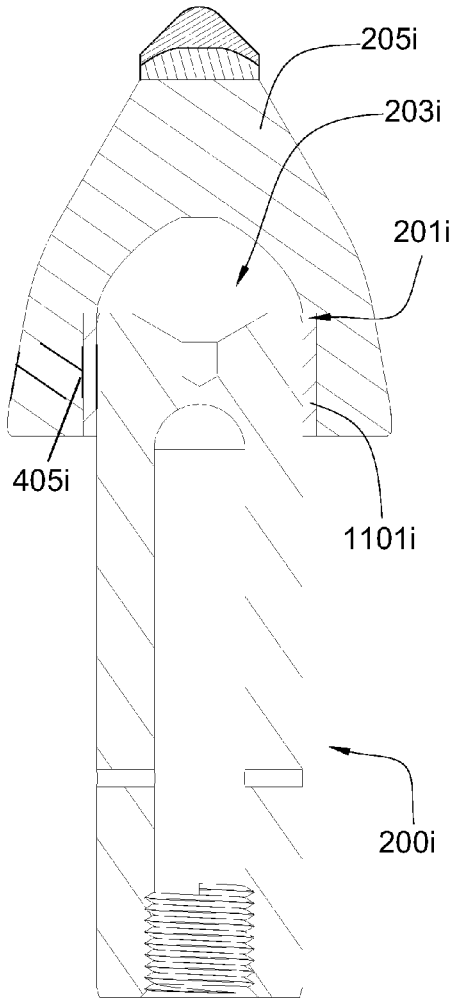
FIG. 12 is a cross-sectional diagram of another embodiment of a pick.

The embodiment of FIG. 12 discloses the split ring 1101 may be disposed in a cavity 203*i* of a bolster 205*i* intermediate a first end 201*i* of a shank 250*i* and an internal surface 405*i* of the bolster 205*i*. Attachment of the shank 250*i* to the bolster 205*i* may induce stress on the bolster 205*i*. The split ring 1101 may mediate the effect of this stress on the bolster 205*i* when the first end 201*i* of the shank 250*i* is press fit into the cavity 203*i*.

Figure 13:
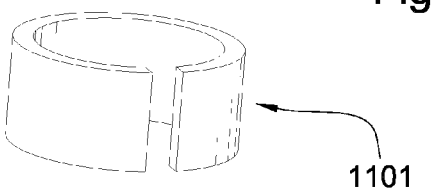
FIG. 13 is a perspective diagram of an embodiment of a split ring.

FIG. 13 discloses a split ring 1101 for use in the embodiments of FIG. 11 and FIG. 12.

Figure 14:
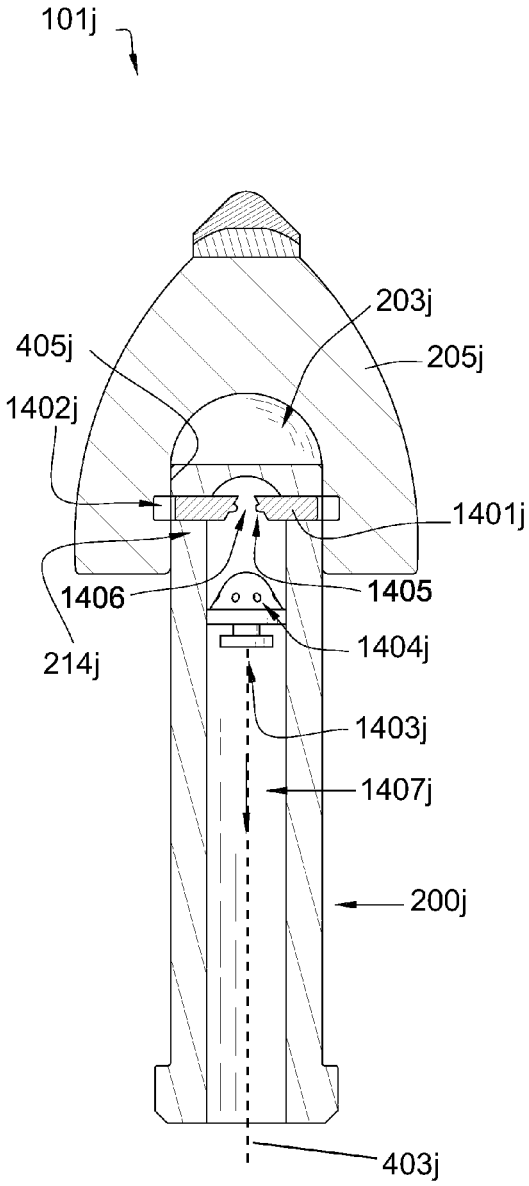
FIG. 14 is a cross-sectional diagram of another embodiment of a pick.

Referring now to FIG. 14, an attachment mechanism 214*j* comprises a plurality of extendable arms 1401*j* that are each perpendicular to a central axis 403*j* of the shank assembly 200*j*. Each of the extendable arms 1401*j* is adapted to interlock with the bolster 205*j* by extending into a recess 1402*j* in an internal surface 405*j* of a cavity 203*j* of a bolster 205*j*. The extendable arms 1401*j* may then maintain attachment between the shank assembly 200*j* and the bolster 205*j*. FIG. 14 also discloses an embodiment in which translation of an activating mechanism 1403*j* in a direction 1407*j* parallel to the central axis 403*j* of the shank assembly 200*j* extends the plurality of extendable arms 1401*j* away from the central axis 404

In FIG. 14 the activating mechanism 1403*j* is easily removable from the attachment mechanism 214*j*. The activating mechanism 1403*j* comprises a plurality of grooves 1404 adapted to interlock with a plurality of protrusions 1405 disposed on an internal end 1406 of the extendable arms 1401*j*. The activating mechanism 1403*j* thereby interlocks with at least a portion of at least one of the extendable arms 1401*j* and thereby maintains the extension of the arm 1401*j* away from the central axis 403*j*. The shank assembly 200*j* may be released from the bolster 205*j* by pulling the activating mechanism 1403*j* away from the rest of the attachment mechanism 214*j*.

Figure 15:
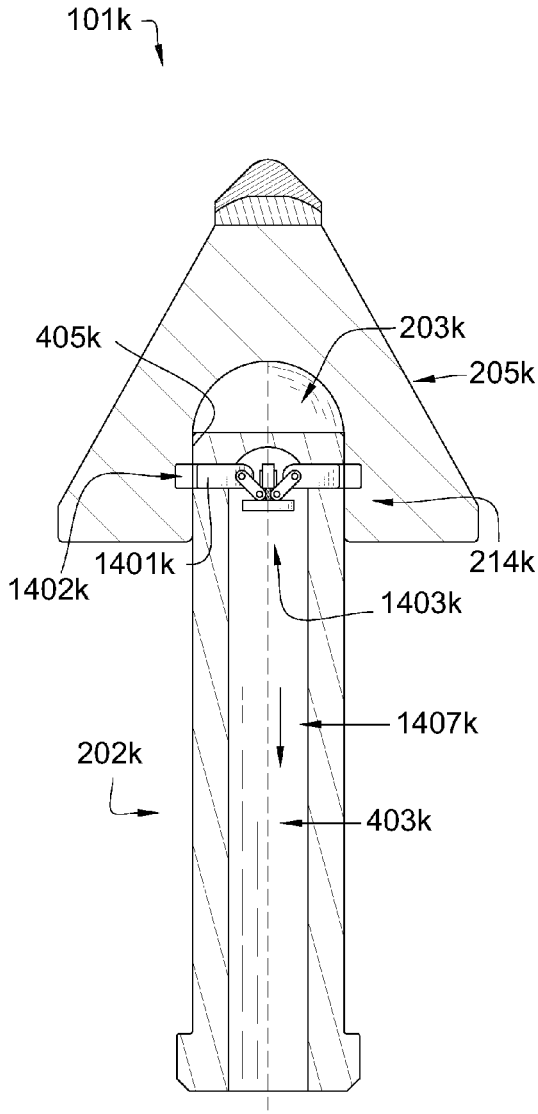
FIG. 15 is a cross-sectional diagram of another embodiment of a pick.

Referring now to FIG. 15, an attachment mechanism 214*j* includes a plurality of extendable arms 1401*k* that are each perpendicular to a central axis 403*k* of the shank assembly 200*k*. Each of the extendable arms 1401*k* is adapted to interlock with a bolster 205*k* by extending into a recess 1402*k* in an internal surface 405*k* of a cavity 203*k* of the bolster 205*k*. The extendable arms 1401*k* may then maintain attachment between the shank assembly 200*k* and the bolster 205*k*. FIG. 15 also discloses an embodiment in which translation of an activating mechanism 1403*k* in a direction 1407*k* parallel to the central axis 403*k* of the shank assembly 200*k* extends the plurality of extendable arms 1401*k* away from the central axis 403*k*. In FIG. 15 the activating mechanism 1403*k* is fixed to the extendable arms 1401*k*.

Figure 16:
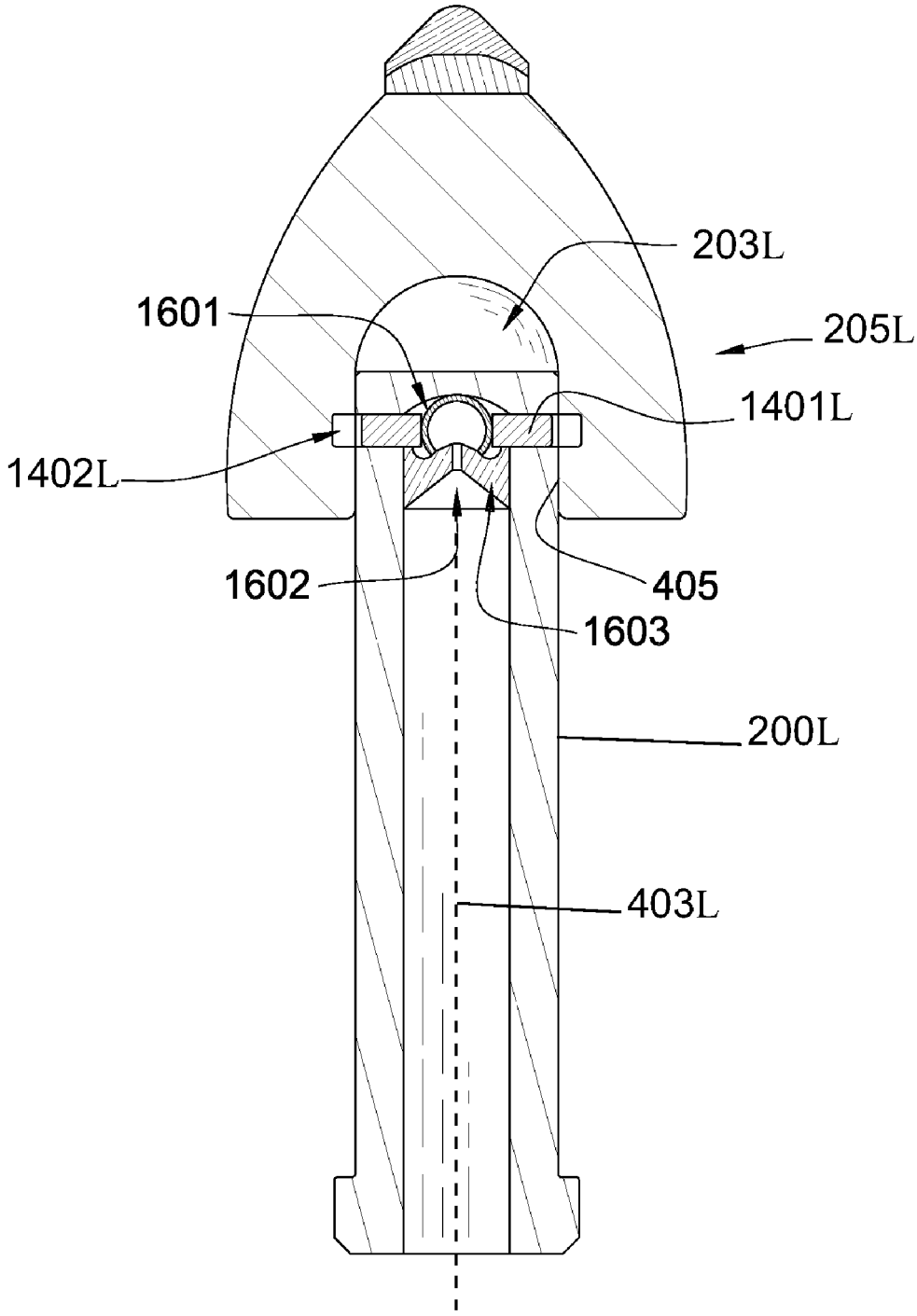
FIG. 16 is a cross-sectional diagram of another embodiment of a pick.

FIG. 16 discloses an embodiment in which fluid pressure on an expandable bladder 1601 disposed within the shank assembly 200L urges the bladder 1601 to expand. As the bladder 1601 expands a plurality of extendable arms 1401L extend away from a central axis 403L of the shank assembly 200L and into a recess 14021 in an internal surface 405L of a cavity 203L of a bolster 205L. A funnel 1602 may be used to direct a fluid into the expandable bladder 1601. An elastomeric seal 1603 may be disposed proximate the expandable bladder 1601 and may allow the bladder 1601 to open while maintaining a seal against the bladder 1601. This may prevent the fluid from leaving the bladder 1601. The bladder 1601 may be adapted to expand to a predetermined distance, after which the bladder 1601 may no longer expand under the fluid pressure. In some embodiments the fluid may be a lubricant. The expandable bladder 1601 may be adapted to return to its original shape once the fluid is removed relieving fluid pressure.

Figure 17:
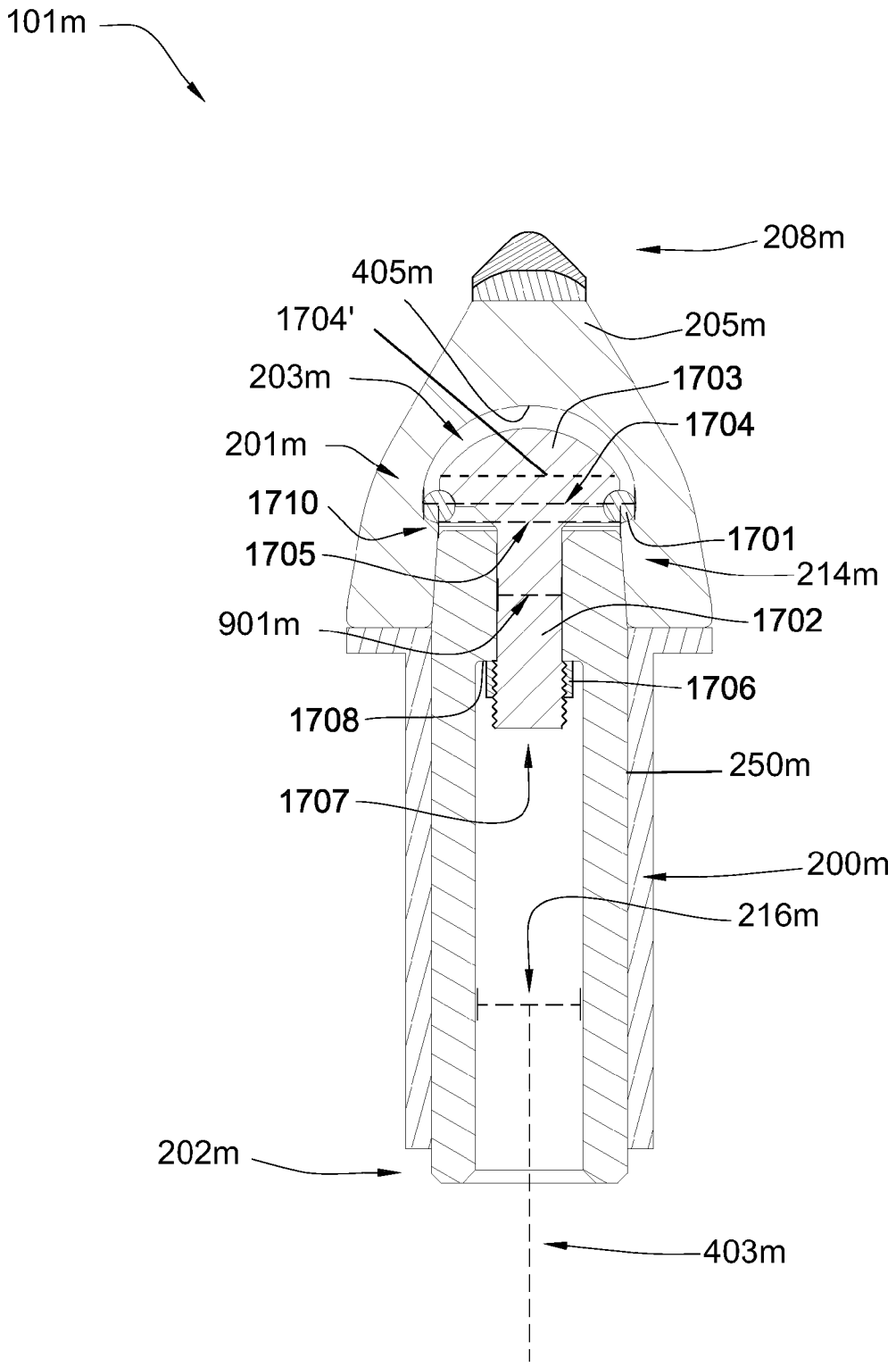
FIG. 17 is a cross-sectional diagram of another embodiment of a pick.

Referring now to the embodiment of a shank assembly 200*m* of FIG. 17, an inducible attachment mechanism 214*m* comprises a insertable locking mechanism 1701 and also a locking shaft 1702. The locking shaft 1702 is connected to an expanded locking head 1703. The insertable locking mechanism 1701 and locking head 1703 are disposed within a cavity 203*m* of a bolster 205*m*. The locking shaft 1702 protrudes from the cavity 203*m* and into an inner diameter 216*m* of a shank 250*m*. The locking shaft 1702 is disposed proximate a constricted inner diameter 901*m* proximate a first end 201*m* of the shank 250*m*. The locking shaft 1702 is adapted for translation in a direction parallel to a central axis 403*m* of the shank assembly 200*m*. The shank 250*m* may pass through the opening 1710 of the cavity 203*m* and then the locking mechanism 1701 may be inserted afterwards. The locking mechanism 1701 may be retained within the cavity 203*m* through a retention shoulder formed in the cavity 203*m*, while protruding into the cavity 203*m* and preventing the shank 250*m* from exiting the opening 1710.

When the first end 201*m* of the shank 250*m* is inserted into the cavity 203*m*, the locking head 1703 may be extended away from the constricted inner diameter 901*m* of the shank 250*m*. The insertable locking mechanism 1701 may be disposed around the locking shaft 1702 and be intermediate the locking head 1703 and the constricted inner diameter 901*m*. The insertable locking mechanism 1701 may comprise an elastomeric material and may be flexible. In some embodiments the insertable locking mechanism 1701 may comprise a metal and/or a flexible metal. The insertable locking mechanism 1701 may be a split ring, a coiled ring, a rigid ring, segments, balls, or combinations thereof.

In embodiments where the insertable locking mechanism 1701 is flexible, the insertable locking mechanism 1701 may comprise a breadth 1704 that is larger than an opening 1710 of the cavity 203*m*. In such embodiments the insertable locking mechanism 1701 may compress to have a smaller breadth 1704' than the available distance 1705. Once the insertable locking mechanism 1701 is past the opening 1710, the insertable locking mechanism 1701 may expand to comprise its original or substantially original breadth 1704.

With both the insertable locking mechanism 1701 and the locking head 1703 past the opening 1710, the first end 201*m* of the shank 250*m* may be further inserted into the cavity 203*m* of the bolster 205*m*. Once the shank 250*m* is inserted into the cavity 203*m* to a desired depth, a nut 1706 may be threaded onto an exposed end 1707 of the locking shaft 1702 until the nut 1706 contacts a ledge 1708 proximate the constricted inner diameter 901*m*. This contact and further threading of the nut 1706 on the locking shaft 1702 may cause the locking shaft 1702 to move toward a second end 202*m* of the shank 250*m* in a direction parallel to the central axis 403*m* of the shank assembly 200*m*. This may also result in moving the locking head 1702 into contact with the insertable locking mechanism 1701, and bringing the insertable locking mechanism 1701 into contact with the internal surface 405*m* of the bolster 205*m*.

Once the nut 1706 is threaded tightly onto the locking shaft 1702, the locking head 1703 and insertable locking mechanism 1701 of the attachment mechanism 214 together are too wide to be removed from the opening 1710.

The contact between the locking head 1703 and the bolster 205*m* via the insertable locking mechanism 1701 may be sufficient to prevent both rotation of the shank assembly 200*m* about its central axis 403*m* and movement of the shank assembly 200*m* in a direction parallel to its central axis 403*m*.

In the present embodiment the attachment mechanism 214*m* is also adapted to inducibly release the shank assembly 200*m* from attachment with the bolster 205*m* by removing the nut 1706 from the locking shaft 1702.

Whereas the present invention has been described in particular relation to the drawings attached hereto, it should be understood that other and further modifications apart from those shown or suggested herein, may be made within the scope and spirit of the present invention.

What is claimed is:

1. A pick, comprising:

a bolster including a base, a cavity disposed within said base, and a surface opposite said base;

a tip disposed adjacent said surface, the tip including a superhard material bonded to a carbide substrate, the carbide substrate being bonded to said surface; and a shank assembly including;

a shank having a central axis, a first end, and a second end, said first end protruding into said cavity and said first end including a radially expandable portion;

an attachment mechanism disposed at said first end, the attachment mechanism configured to expand said radially expandable portion about said axis within said cavity, thereby engaging an internal surface of said cavity.

2. The pick of claim 1, wherein said attachment mechanism is adapted to restrict rotation of the shank about said central axis when said shank is attached to the bolster.

3. The pick of claim 1, wherein said attachment mechanism is further adapted to release said shank assembly from attachment with said bolster.

4. The pick of claim 1, wherein said attachment mechanism comprises a insertable locking mechanism and a locking shaft connected to an expanded locking head, said insertable locking mechanism and said locking head being disposed within said cavity of said carbide bolster, and said locking shaft protruding from said cavity into an inner diameter of the shank assembly and being adapted for translation in a direction parallel to said central axis of the shank assembly.

5. The pick of claim 1, wherein said attachment mechanism comprises a wedge disposed within said cavity of the bolster.

6. The pick of claim 5, wherein said wedge is fixed to said bolster.

7. The pick of claim 1, wherein said first end of the shank assembly is adapted to expand when a wedge is inserted into said first end.

8. The pick of claim 1, wherein said first end of said shank assembly has a plurality of prongs that are adapted to interlock with said cavity of the bolster.

9. The pick of claim 1, wherein said attachment mechanism attaches said shank assembly to said bolster by radially expanding at least a portion of said shank assembly.

10. The pick of claim 1, wherein an internal surface of said cavity comprises outwardly tapered surfaces.

11. The pick of claim 1, wherein said shank assembly comprises a hollow portion disposed within an inner diameter and an opening to the hollow portion in a second end of said shank assembly.

12. The pick of claim 1, wherein said shank assembly includes a wedge disposed within an inner diameter of said shank.

13. The pick of claim 12, wherein said wedge includes a first set of threads that corresponds to a second set of threads disposed on an inner surface of said shank.

14. The pick of claim 1, wherein a split ring is disposed in said cavity of said bolster intermediate said first end of said shank assembly and an inner surface of said bolster.

15. The pick of claim 1, wherein said attachment mechanism has a plurality of extendable arms that are each perpendicular to a central axis of said shank assembly.

16. The pick of claim 15, wherein each of said plurality of extendable arms is adapted to interlock with said bolster by extending into a recess disposed in said cavity of said carbide bolster.

17. The pick of claim 15, wherein fluid pressure on an expandable ring disposed within said shank assembly causes said ring to expand and thereby extend said plurality of extendable arms away from said central axis.

18. The pick of claim 15, wherein translation of an activating mechanism in a direction parallel to said central axis extends the plurality of extendable arms away from said central axis.

19. The pick of claim 18, wherein said activating mechanism interlocks with at least a portion of at least one of said plurality of extendable arms and thereby maintains the extension of the arm away from said central axis.

20. The pick of claim 12, wherein said wedge is disposed at said first end of said shank.

21. The pick of claim 12, wherein said shank further includes a seat disposed at said radially expanding portion, said seat being configured to receive said wedge.

22. The pick of claim 1, wherein said radially expanding portion is deformable.

23. The pick of claim 1, wherein said radially expanding portion includes a prong extending axially.

* * * * *